United States Patent [19]

Crouser et al.

[11] Patent Number: 4,888,851

[45] Date of Patent: Dec. 26, 1989

[54] BRUSH MOUNTING ARRANGEMENT

[75] Inventors: Darwin S. Crouser, North Canton; Vincent L. Weber, North Lawrence, both of Ohio

[73] Assignee: The Hoover Company, North Canton, Ohio

[21] Appl. No.: 299,395

[22] Filed: Jan. 23, 1989

[30] Foreign Application Priority Data

Feb. 3, 1988 [FR] France ..... 88 01238
Feb. 3, 1988 [GB] United Kingdom ..... 8802361

[51] Int. Cl.[4] ..... A47L 9/06
[52] U.S. Cl. ..... 15/371; 15/354
[58] Field of Search ..... 15/354, 355, 368, 371, 15/373

[56] References Cited

U.S. PATENT DOCUMENTS 3,013,294 12/1961 Ostrom ..... 15/373
3,040,364 6/1962 Carlberg ..... 15/373 X
3,040,368 6/1962 Nilsson ..... 15/373
3,204,281 9/1965 Lamken et al. ..... 15/377 X
3,729,769 5/1973 Sharpless ..... 15/371 X
3,952,363 4/1976 Lindman ..... 15/373
4,638,526 1/1987 Murata et al. ..... 15/373 X

FOREIGN PATENT DOCUMENTS 360776 4/1962 Switzerland ..... 15/373

*Primary Examiner*—Chris K. Moore

[57] ABSTRACT

The invention comprehends the use of a brush mounting housing mounted over a nozzle housing so as to dispose brushes forwardly and rearwardly of a nozzle opening. The brush mounting housing is pivotally mounted relative to the nozzle housing so that the forward and rearward brushes may be movable relative to the nozzle. The brush mounting housing is advantageously pivoted to the nozzle at the location of nozzle housing pivot to a wand coupling for the floorcare appliance.

7 Claims, 4 Drawing Sheets

BRUSH MOUNTING ARRANGEMENT

RELATED APPLICATIONS

This is a substitute for application Ser. No. 07/010,915 owned by a Common Assignee, and now abandoned.

BACKGROUND OF THE INVENTION

1. Field of the Invention

This invention relates to floor care appliances and, more particularly, relates to a vacuum nozzle having a brush mounting arrangement.

2. Summary of the Prior Art

Heretofore vacuum nozzles have been provided with agitators such as brushes to aid in the cleaning function by, for example, facilitating nozzle travel or dislodging dirt so the same may be removed by suction. Nozzles are even known in which the brushes are mounted to a framework simply pivoted outside of the nozzle body proper so as to enable an extensive nozzle opening without recourse to inward pivoting of the brush structure and a consequent use of small, numerous parts on a very large nozzle outline. Nozzles are even known where the brush supporting structure is advantageously, temporarily mounted over its nozzle body but no nozzles are known where the brush mounting housing is mounted over the nozzle to yield nozzle simplicity and the possibility of a large nozzle opening without resort to an excessively large appliance outline and is also pivoted to the nozzle so as to provide adjustment for it.

Accordingly, it is an object of this invention to mount its brush structure over the nozzle body.

It is a further object of the invention to pivot the brush structure to the nozzle body so as to provide adjustability therebetween.

It is even a further object of the invention to mount its brushes on a housing that envelopes over the nozzle, per se.

It is a still further object of the invention to pivot the brush supporting structure to the nozzle at the nozzle-wand coupling pivot to provide proportionate response therebetween.

Other and further objects of the invention will appear as the description of the invention proceeds.

SUMMARY OF THE INVENTION

The invention provides a cleaning appliance having, generally, a nozzle part and a brush carrying part. The nozzle part includes a nozzle opening adjacent its bottom and a central passageway that communicates conventionally, with a wand coupling member to which a rear portion of the nozzle part is pivoted, confluently. The brush carrying part takes the form of an outer housing that is disposed over the nozzle. It carries forward and rearward brush strips which are disposed to extend along the front and rear sides of the nozzle opening and it is pivoted at its rear on the same axis as the nozzle-wand coupling pivot.

A pair of rear wheels are located at this pivot axis, with the brush carrying part having pivot pins elastically engaging in pins on the wand coupling part that form the general pivot for it and the brush carrying parts. The brush carrying part includes a pair of spaced, vertical side walls that tend to maintain it, the nozzle part and the aforesaid wheels in assembled condition.

The nozzle part and the brush carrying part are resiliently urged together by a pair on conical compression springs which act therebetween and tend to move the brush part against the nozzle so as to resiliently urge the brush strips towards the floor. A pair of pivoted linked levers capable of moving over center are disposed to extend outwardly of the brush carrying part for operation initiation to move the brush strips upwardly away from the nozzle part into a less extended position relative to the surface on which the nozzle is disposed.

BRIEF DESCRIPTION OF THE DRAWINGS

Reference now may be had to the accompanying Drawings for a better understanding of the invention, both as to its organization and function, with the illustration being of a preferred embodiment, but being only exemplary, and in which.

DETAILED DESCRIPTION OF THE INVENTION

Figure 1:
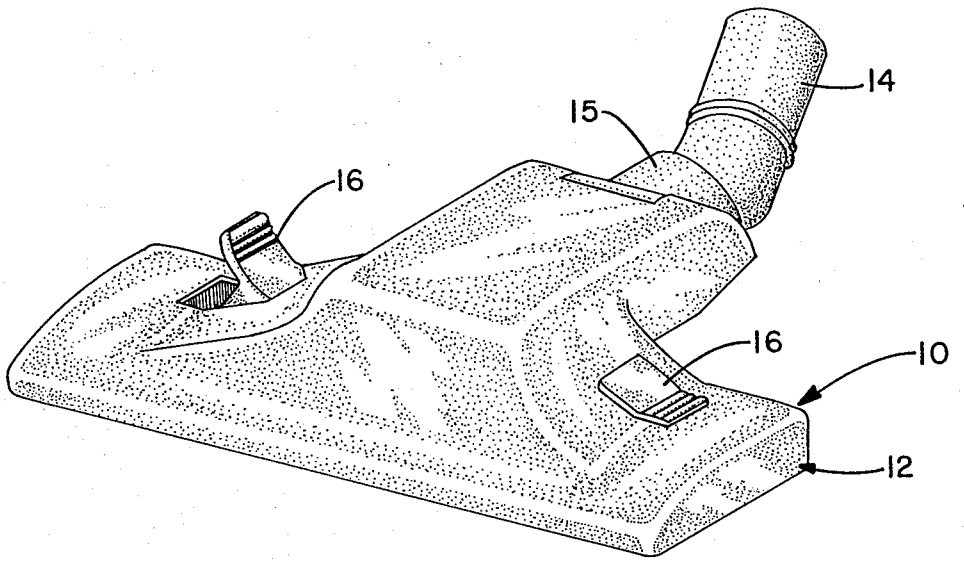
FIG. 1 is a perspective view of a cleaning appliance incorporating the invention.
Figure 2:
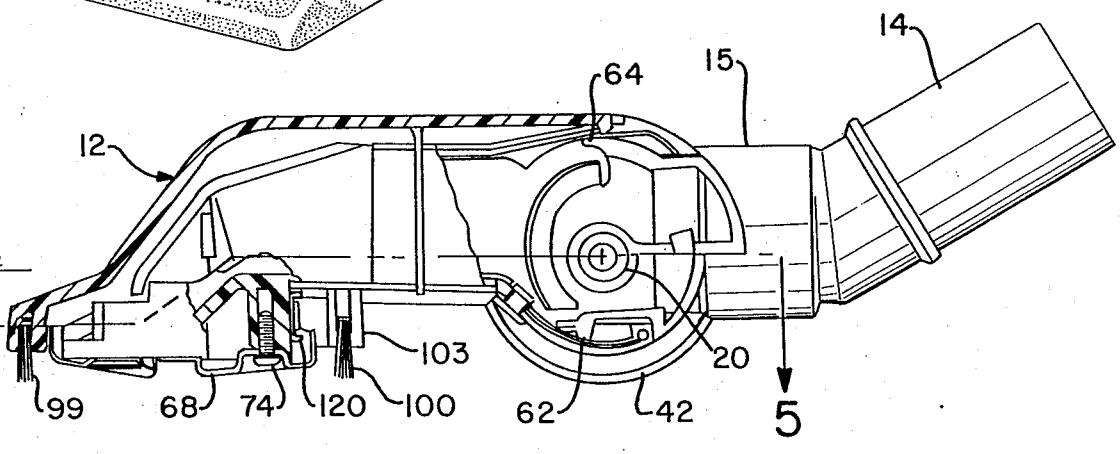
FIG. 2 is a central, cross sectional view of the invention.
Figure 3:
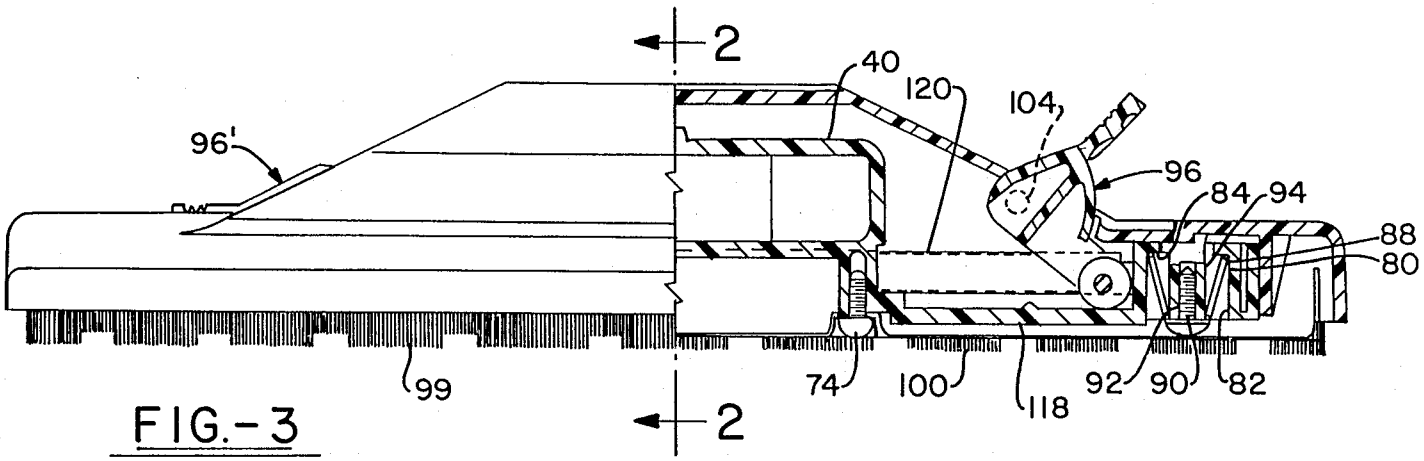
FIG. 3 is a front elevational view, partly in cross section, of the invention with the brushes extended.

There is shown in FIG. 1, a cleaning appliance 10 having a brush mounting piece 12 which serves as the housing cover for the cleaning appliance 10. A wand coupling 14 is telescopically inserted into a wand coupling pivot piece 15 and is conventionally disposed at the rear of the cleaning appliance 10, while a pair of pedals 16, 16 extend above the brush mounting pieces 12 to serve as an operator actuated adjusting means that will be explained later in this description.

Turning to the remaining Figures of the Drawings, it can be seen that the brush mounting piece 12 is received over and substantially surrounds a nozzle piece 18 and is pivoted thereto in the following manner. Wand coupling pivot piece 15 includes a pair of integral sidewardly extending cylindrical bosses 20,20 that form the axis for pivoting of the cleaning appliance 10 relative to wand coupling 14 and wand coupling pivot piece 15. These bosses are inserted through bores 22,22 formed on a pair of vertical flanges 24, 24 disposed in a pair of parts 26, 28 that form nozzle piece 18. These parts are generally mirror images of one another and only differ at their adjoining borders where part 28 of nozzle piece includes a lower tennion 30 and an upper tennion 32 at an inward termination of its lower and upper, generally horizontally, extending walls 34, 36, respectively. These tennions mate with grooves (not shown) at inward terminations of lower and upper generally horizontally extending walls 38, 40, respectively, or part 26.

A pair of rear wheels 42, 42 are next mounted on cylindrical bosses 20, 20 by being telescoped over the bosses by means of bores 44, 44 extending through the wheels 42, 42. These bores are slightly larger in diameter than the bosses so as to permit the wheels 42, 42 to rotate freely therein. This entire assemblage is capped by brush mounting piece 12 having vertical, rear, wall yokes 46, 46, spaced from each other approximately the distance between the outer faces 48, 48 on the mounted wheels 42, 42. The yokes 46, 46 include integral, inwardly extending pins 50, 50 which engage in bores 52, 52 in outwardly extending cylindrical bosses 20, 20 on wand coupling pivot piece 15 when the brush mounting piece 12 is outwardly deformingly mounted over the assembled wheels 42, 42. At this location the wall yokes 46, 46 compressingly maintain the wand coupling piece 15, the nozzle piece 18, and the wheels 42, 42 in assembled condition.

The nozzle piece 18 includes a nozzle opening 54 that extends transversely relative to the depth of the nozzle piece 18, nearly from side to side of the nozzle piece to provide a wide sweeping area. This is, in part, due to the fact that there is no obstructive interference with it by the brush piece 12. The nozzle opening 54 merges upwardly into a rearwardly tapering transition duct section 56 that, in turn, is confluently connected to a ball joint duct section 58. This section receives a rounded duct section 60 on wand coupling pivot piece 15, seal being provided by a pair of sealing surfaces 62, 64 on the wand coupling pivot piece 15 conventionally engaging against internal surfaces on the ball joint duct section 58. The cylindrical bosses 20 and wall yokes 46 on brush mounting piece 12 as already related, maintain the wand coupling pivot piece 15 and nozzle piece 18 assembled in this confluent condition.

The nozzle piece 18 also includes a pair of screw bosses 66, 66 which aid in the mounting of a bottom plate 68 on the bottom side of nozzle piece 18, through screws 70, 70 that extend through countersunk bores 72, 72 in bottom plate 68 and into the bosses 66, 66. A pair of rear screws 74, 74 also extend through bottom plate 68 to engage in threaded bores 76, 76 in nozzle piece 18. Bottom plate 68 includes a suction opening 78 substantially coextensive to the nozzle opening 54 of nozzle piece 18.

The nozzle piece 18 also includes a pair of spring wells 80, 80 disposed behind the screw bosses 66, 66, with these wells each formed by a bore 82 closed at its inner end by an inner seat 84. A compression spring 86 of truncated conical shape is disposed so as to have an inner end 88 abuttingly, compressingly engaging the inner seat 84 of spring well 80 of nozzle piece 18 to urge it upwardly. The other end of spring 86 engages against the bottom side of a head 90 of a screw 92 to resiliently urge this screw downwardly. This screw is threadedly inserted in an integral downwardly depending boss 94 of the brush mounting piece 12 which is also urged, sequentially, downwardly by the spring 86 so that the brush mounting piece 12 and nozzle piece are resiliently urged together by the springs 86, 86.

The brush mounting piece 12 also mounts a pair of actuating levers 96, 96' which are utilized to move the nozzle piece 18 against the action of the springs 86, 86 to separate the nozzle piece 18 and brush mounting piece 12 and effectively, ideally, retract a pair of brush strips such as forward and rearward brush strips 98, 100, respectively.

These brush strips are mounted in slots 99 and 101 formed in brush mounting piece 12. The slots open downwardly for the upward reception of the brush strips which are wedgingly held therein. A reinforcement piece 103 is utilized with brush strip 100 since its slot 101 is discontinuous in the center portion of the brush mounting piece 12.

The levers 96, 96 each include aligned, outwardly extending pins 102, 104 integral therewith, which extend generally transversely to and horizontally relative to the major extent of the levers, a pedal section 106 and trunnion sections 108, 108' disposed below the pedal section 106 and carrying a pin 110 mounting a roller 122. The levers 96, 96 are each mounted by pins 102, 104 being received in wells 114, 116, formed in the bottom side of the brush mounting piece 12 with the levers 96, 96, being also captured between the brush mounting piece 12 and the nozzle piece 18 so that each of the rollers 112 may move along a surface 118 formed on the nozzle piece 18.

The levers 96, 96 are connected together by a thrust link 120 which is mounted to and extends between the levers 96, 96 on the pins 110. This link is disposed on the rear side of the levers 96, 96 in a space afforded for it and may slightly swing and move rectilinearly as the levers 96, 96 are turned to extend or retract the brush strips 98, 100. The pedals sections 106 are disposed conveniently so that one is always up while one is always down so that foot engagement of one of the pedal sections is always available for the operator of the cleaning appliance 10.

Figure 6:
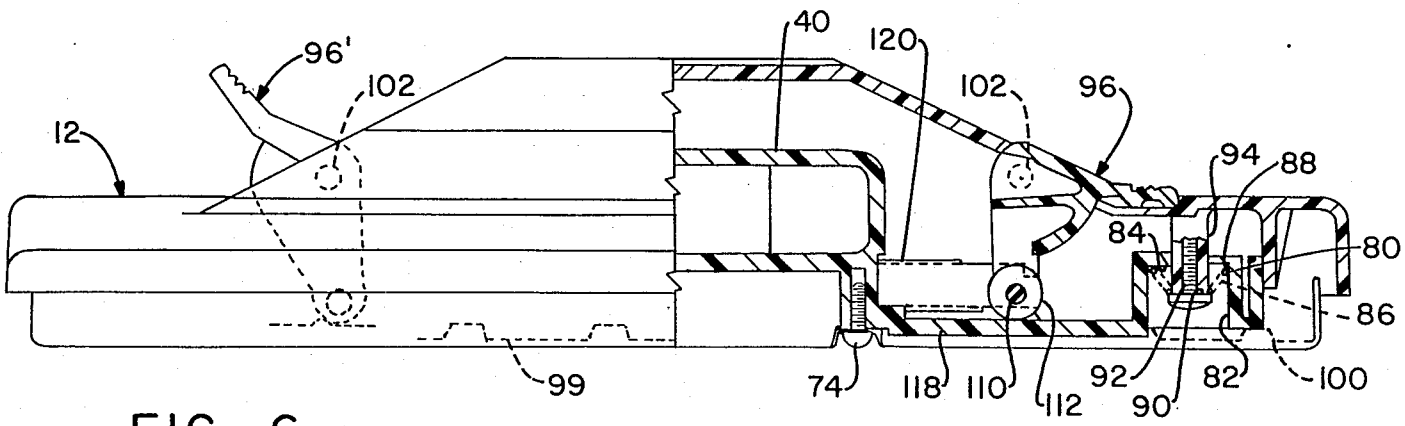
FIG. 6 is a view-like FIG. 3 with the brushes retracted.
Figure 4:
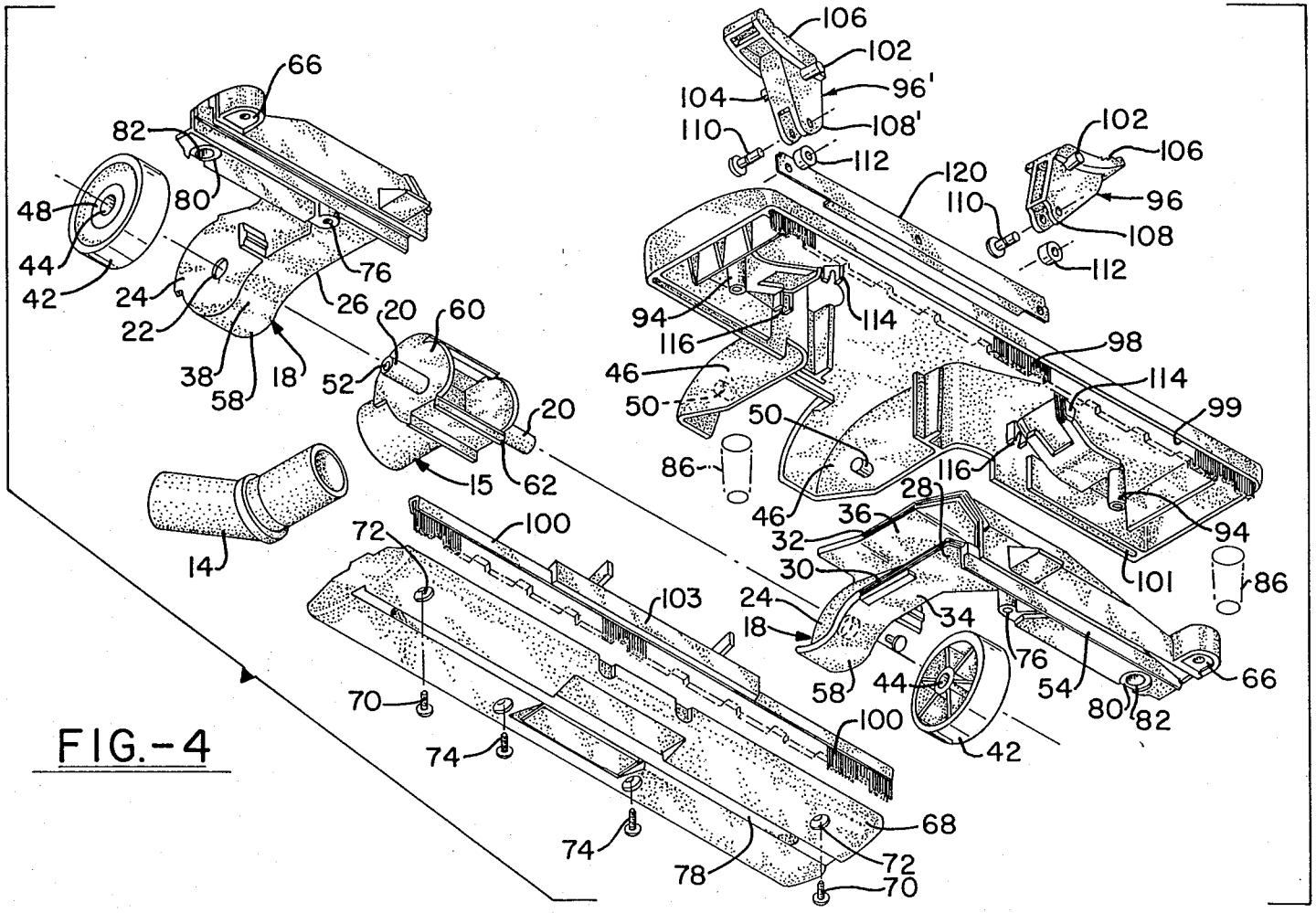
FIG. 4 is an exploded perspective view of the invention.
Figure 5:
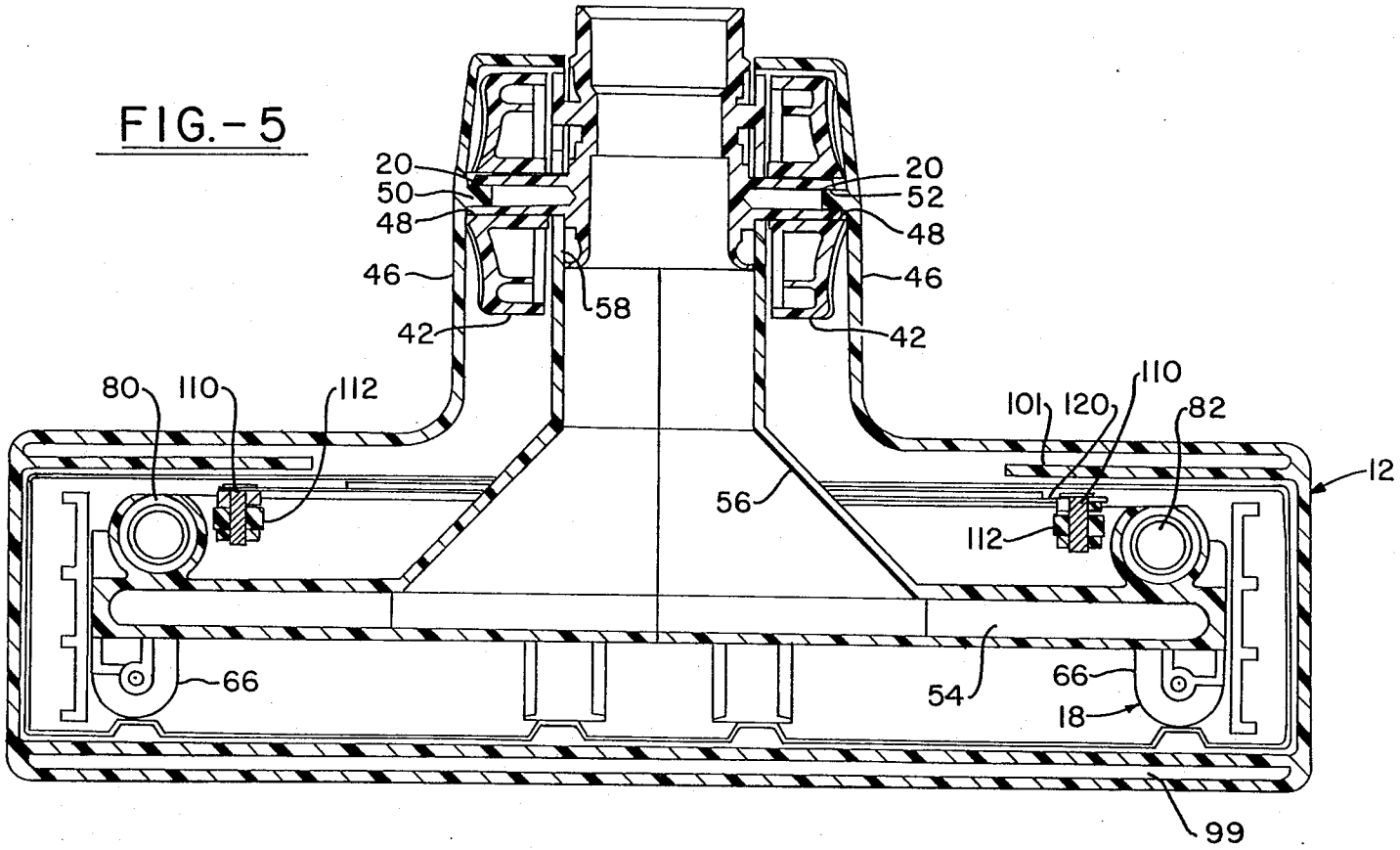
FIG. 5 is a cross sectional view of the invention taken on line 5—5 of FIG. 2.

The operation and structure of the cleaning appliance 10 should now be clear. The brush mounting piece 12 sits over and serves as a cover or housing for the nozzle piece 18 with both of these pieces pivoted to the wand coupling pivot piece 15. Springs 86, 86 tend to maintain the brush mounting piece 12 and nozzle piece 18 in close contiguity so that the brush strips 98, 100 are, in effect, extended. Manipulation of the actuating levers 96, 96 in the desired direction forces the nozzle piece 18 downwardly (FIG. 6), thereby raising the brush strips 98, 100. At all times, the brush strips 98, 100, as carried by the brush mounting piece 12 operate outside of the extended suction opening 78 without interference with it or the nozzle piece 18 and without resort to a number of small parts required to fit tightly within a conventional nozzle housing.

Accordingly, it should appear clear that the objects of the invention have been obtained by the inventive structure described. It also should be clear that many modifications could be made to it obviously by one skilled in the art, still within the purview of the description and without resort to invention.

What is claimed is:

1. A floor care appliance having a wand, and including;
   (a) means forming a nozzle for said floor care appliance,
   (b) means mounting an agitator in said floor care appliance,
   (c) said means mounting an agitator being disposed substantially surrounding said means forming a nozzle, and
   (d) said means mounting an agitator and said means forming a nozzle are each adapted to be pivoted to said wand to move relative to each other.

2. The floor care appliance of claim 1 wherein;
   (a) said means mounting an agitator includes a housing covering said means forming a nozzle.

3. The floor care appliance of claim 1 wherein;
   (a) said pivoting of said means forming a nozzle to said wand being accomplished by a pivot at least partly formed by pins extending sidewardly from said wand.

4. The floor care appliance of claim 3 wherein;
   (a) said pins extend through walls on said means forming a nozzle to form said pivot with it, (b) said sidewardly extending pins mount wheels for relative rotation therebetween, and (c) said means mounting an agitator includes means engaging with said pins to limit outward movement of said walls.

5. The floor care appliance of claim 4 wherein;

(a) said means engaging with said pins include vertical abutting walls.

6. The floor care appliance of claim 3 wherein;

(a) said sidewardly extending pins also provide for at least a portion of the pivot for said pivoting of said means mounting an agitator to said wand.

7. The floor care appliance of claim 6 wherein;

(a) said sidewardly extending pins include axially extending bores, (b) said engaging means include second sidewardly extending pins, (c) said second sidewardly extending pins engaging in said bores to afford said pivoting of said means mounting a agitator.

* * * * *